US008312812B2

(12) United States Patent
Kapeles et al.

(10) Patent No.: US 8,312,812 B2
(45) Date of Patent: Nov. 20, 2012

(54) RELOADABLE TRAINING AMMUNITION

(75) Inventors: John A. Kapeles, Casper, WY (US); John A. Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 1035 days.

(21) Appl. No.: 11/845,552

(22) Filed: Aug. 27, 2007

(65) Prior Publication Data

US 2011/0000392 A1 Jan. 6, 2011

Related U.S. Application Data

(60) Provisional application No. 60/916,746, filed on May 8, 2007.

(51) Int. Cl.
*F42B 8/02* (2006.01)

(52) U.S. Cl. ..... 102/444; 102/447; 102/470

(58) Field of Classification Search ..... 102/439, 102/444, 447, 470, 501, 502, 529
See application file for complete search history.

(56) References Cited

U.S. PATENT DOCUMENTS

| | | | | |
|---|---|---|---|---|
| 228,494 | A | 6/1880 | Valentine | |
| 3,667,395 | A * | 6/1972 | Romer et al. | 102/529 |
| 3,714,896 | A | 2/1973 | Young | |
| 4,164,903 | A | 8/1979 | Bouza | |
| 5,086,703 | A | 2/1992 | Klein | |
| 5,239,928 | A | 8/1993 | Ricci | |
| 5,259,319 | A | 11/1993 | Dravecky et al. | |
| 5,402,729 | A | 4/1995 | Richert | |
| 6,041,712 | A | 3/2000 | Lyon | |
| 6,494,069 | B1 | 12/2002 | Ireblad et al. | |
| 6,832,557 | B2 * | 12/2004 | Torsten | 102/439 |
| 7,287,475 | B2 | 10/2007 | Brunn | |
| 2003/0136293 | A1 | 7/2003 | Torsten | |
| 2007/0181029 | A1 * | 8/2007 | Mcaninch | 102/430 |
| 2008/0098922 | A1 * | 5/2008 | Gleue | 102/447 |

FOREIGN PATENT DOCUMENTS

| | | |
|---|---|---|
| WO | WO 83/00213 | 1/1983 |

OTHER PUBLICATIONS

International Search Report and Written Opinion for Application No. PCT/US08/061329; date mailed Dec. 12, 2008; search and opinion completed Dec. 4, 2008; 6 pages.

* cited by examiner

*Primary Examiner* — James Bergin
(74) *Attorney, Agent, or Firm* — Kane Kessler, P.C.; Paul E. Szabo

(57) ABSTRACT

A reloadable munition having a reusable shell base having a hollow cavity on a bottom face to accept a propulsion system reload and a reusable projectile inserted into a top portion of the shell base, and a mechanical retainer for the propulsion system reload in the shell base to provide reloading and reusing of the munition by hand.

7 Claims, 3 Drawing Sheets

RELOADABLE TRAINING AMMUNITION

CROSS-REFERENCE TO RELATED APPLICATION(S)

This application claims priority to U.S. Provisional Patent Application No. 60/916,746 filed May 8, 2007.

BACKGROUND OF THE INVENTION

The present invention relates generally to the field of munitions, and more specifically to reloadable training ammunition. Law enforcement and military personnel require a need to regularly train in the use of munitions to achieve and maintain proficiency in their deployment. For example, less lethal impact munitions which impart blunt energy to redirect, control or incapacitate aggressive human targets, depends upon accurate shot placement to achieve the desired outcome while minimizing the risk of serious injury. As with any munition fired from a firearm or launcher, accurate and consistent shot placement is only achieved through repetitive training with the actual munitions or realistic training variant.

With the increased use of impact munitions by law enforcement and military forces, as well as the increased number of those forces, there is a need for a cost-effective training munition that matches the performance of the actual munition while allowing the user to easily reload and re-use the training munition in the field. For munitions that incorporate a high/low pressure propulsion system, it is critical to duplicate the features of this propulsion system design in order to achieve the same performance in a reloadable training munition. Many high/low pressure design munitions incorporate blank propellent cartridges that control the exact amount of propellent used, rupture discs of specified thickness, and vent holes of specific diameters. These features must be duplicated to achieve the same projectile velocities and shot-to-shot variation in the reloadable training munition as in the actual munition.

Various types of prior training and reload kits have been marketed and sold that involve reloading the actual munition projectiles into new loaded shell bases. Such designs or kits result in performance approximating the actual munition, but only at a minor cost savings. In order to achieve more of a cost savings, users of these training and reload kits have attempted to reload the shell bases by pressing out the fired blank cartridges and pressing in new cartridges. These efforts have been without success because such an operation needs to be done in a workshop with the proper equipment such as presses and holding fixtures which are not available in the field. The reloading operation consequently was frequently done incorrectly without duplicating the features of the high/low pressure propulsion system, and did not produce consistent performance when firing the projectiles, which decreased the value of the training.

Other prior training systems were developed that employ a reloadable blank cartridge insert that was pushed into the shell base and secured by glue. These systems have had poor results in the field because the glue used to secure the reload can accumulate on the wear face of the blank cartridge primer, in sufficient quantity to cause accidental discharge of the weapon when the breach was closed. In addition, this design did not allow the user to change out the reload in the field without the use of a press.

All current prior reloadable training munition systems share the same problem in that they are not easily reloaded in the field to allow rapid turn-around time and optimum use of training time on the range. To be reloaded properly and safely, these munitions require the use of special equipment and presses, and operations that should be done in a workshop environment. Consequently, a need exists for a reloadable training munition that accurately reproduces the performance of the actual munition, is easily and safely reloaded in the field without the use of specialized equipment, and achieves the goal of significant cost savings.

SUMMARY OF THE INVENTION

The present invention is directed to a reloadable training munition system that incorporates a reusable projectile, a reusable shell base to house a propulsive reload, and a reload insert that houses a blank smokeless propellent cartridge, rupture disc, and vent hole of a high/low pressure propulsion system. The propulsive reload can be inserted by hand into the shell base, where it is secured by a mechanical means such as a set screw, lock ring, or threaded interface that does not require specialized equipment to install. The projectile also can be inserted by hand. The entire reloading operation can be accomplished in the field to perform multiple firings with minimal turn-around time. Significant cost savings is achieved through the lower cost of the reusable hardware components, as well as the time savings resulting from the ability to reload the munitions in the field.

DETAILED DESCRIPTION OF THE INVENTION

Figure 1:
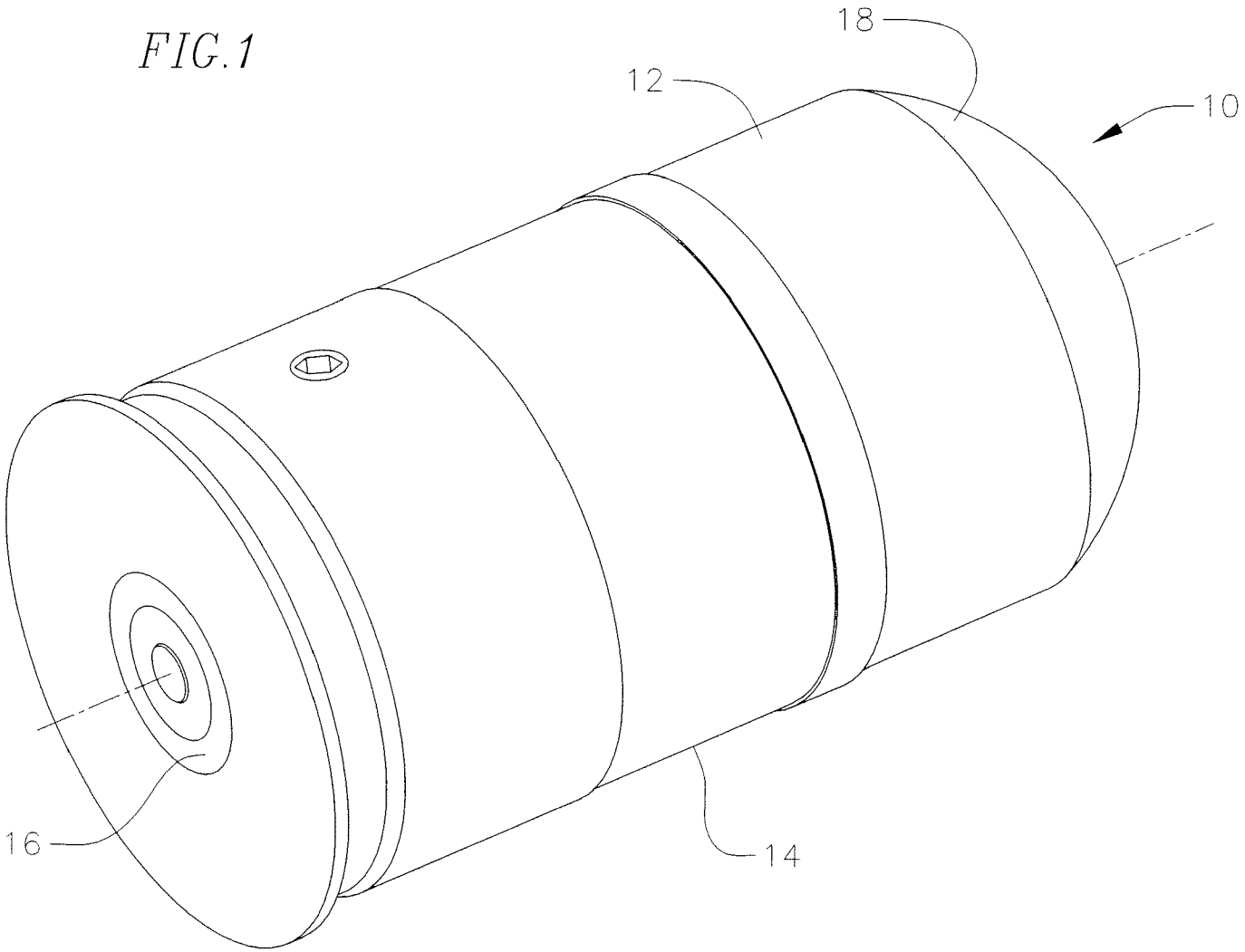
FIG. 1 is a perspective view of a reloadable training ammunition of the present invention.

Referring to the drawings, a reloadable training munition 10 of the present invention is illustrated. The munition 10 comprises three main components, namely a reusable projectile 12, a reusable shell base 14 and a reload insert 16. The reusable projectile 12 has a nose section 18 which is designed to closely simulate the weight, flight stability and aerodynamic characteristics of an actual munitions projectile, but utilizing materials and manufacturing techniques to reduce the cost and allow the projectile to be reused numerous times without loss of performance. For example, an actual munition projectile could be a multi-component projectile made of plastic and foam components bonded together and the reusable projectile which would replace the actual munitions could be a single-piece, molded plastic projectile. Depending upon the actual munition projectile the reusable projectile is replacing, the projectile can be solid or can be hollow. The reusable projectile has a reduced diameter neck portion 20 sized to provide an interference fit inside the reusable shell base and can be inserted into the shell base by hand.

The reusable shell base 14 has the same internal and external dimensions as a single use shell base to preserve the interface and fit with the projectile and the weapon platform. The reusable shell base incorporates the hollow cavity 22 in the bottom of the shell which accepts the reload insert 16. The internal diameter of a hollow cavity is designed with sufficient tolerance to allow the reload insert to be loaded or removed by hand. The reload insert 16 houses a blank cartridge 24 and a rupture disc 26. The reload insert also has a vent hole 28 (seen best in FIG. 3) which together with the propellent cartridge and rupture disc form the high/low pressure propulsion system.

Figure 2:
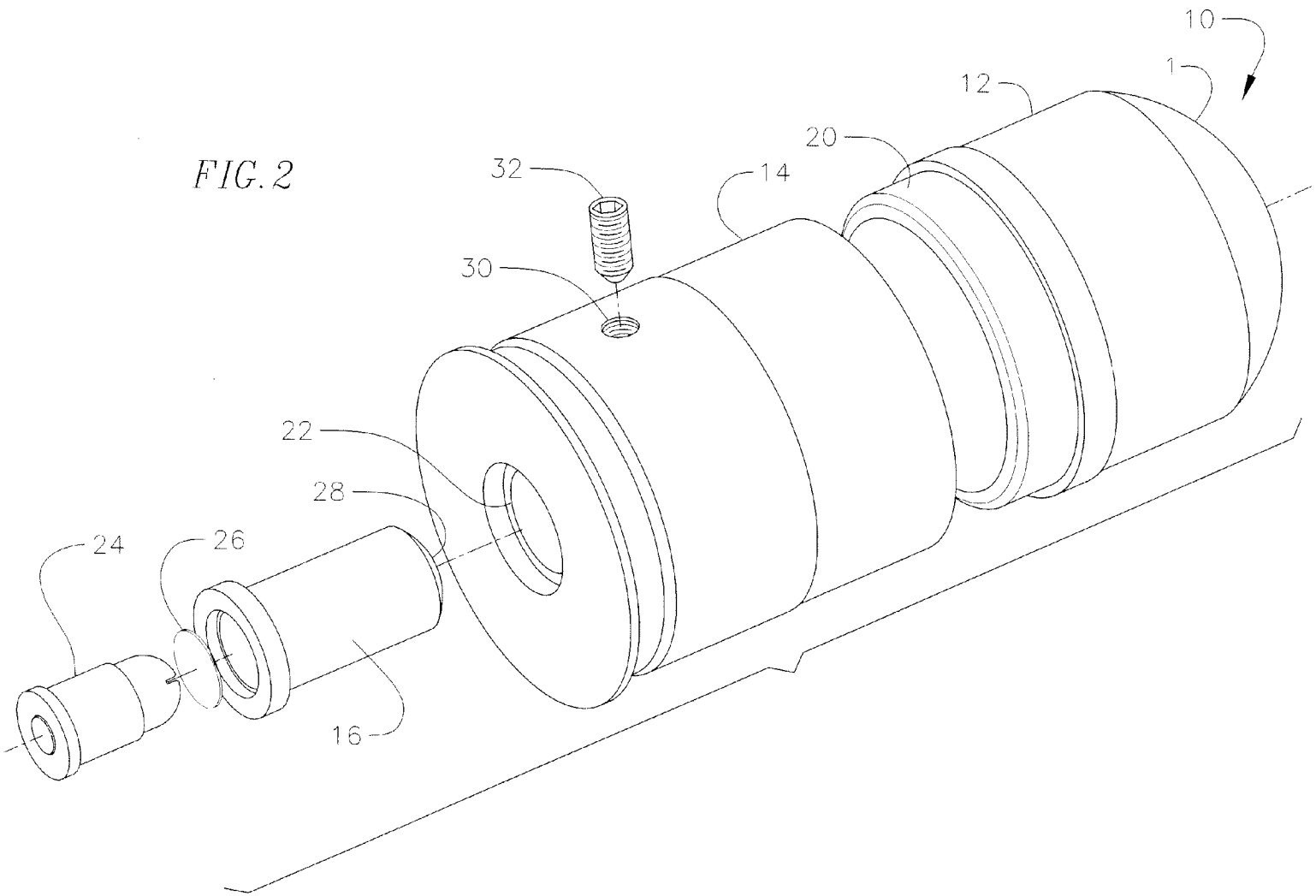
FIG. 2 is an exploded view of the ammunition of FIG. 1.

To retain the reload insert within the reusable shell base, a mechanical attachment means is incorporated. For example as shown in FIG. 2, a threaded hole 30 extends from the external surface of the shell to the longitudinal axis of the shell and intersecting the hollow cavity 22. A set screw 32 is threaded into the hole and can be tightened to move the screw towards the hollow cavity and engage the reload insert. Consequently, when a reload insert is in place in the hollow cavity and the set screw tightened, the set screw provides a mechanical means of securing the reload insert into the reusable shell base. When the set screw is loosened, the reload insert can be easily removed by hand with simple hand tools such as an allen wrench.

Figure 3:
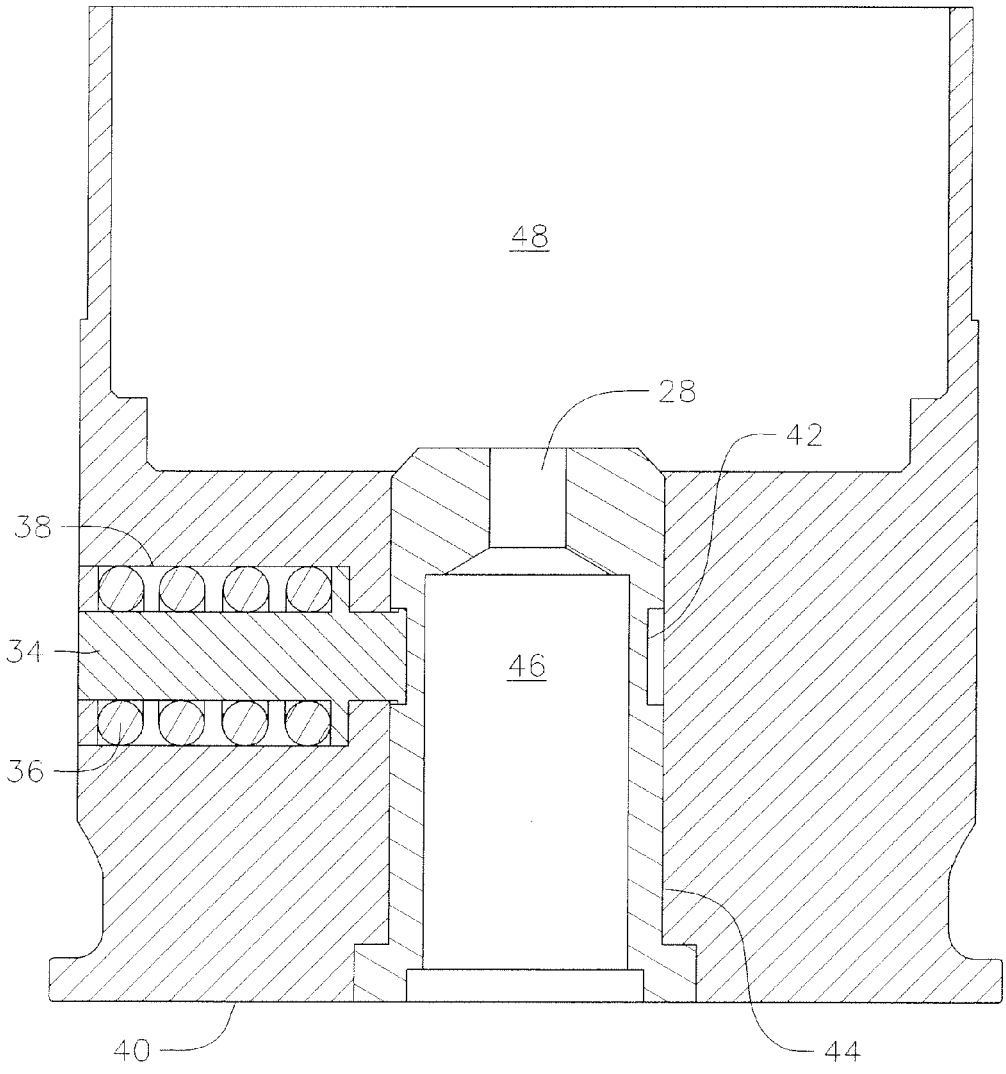
FIG. 3 is a cross-sectional view of an alternative reusable shell base and reload insert of the present invention.

As shown in FIG. 3, other forms of mechanical retention systems can be utilized such as a spring loaded locking pin 34. Locking pin 34 includes a spring 36 which are positioned within a hole 38 extending into the shell base 40. The end of the pin 34 engages a groove 42 extending around the parameter of the reload insert 44. When inserting the reload insert, the pin would be displaced out of the hollow cavity by compressing the spring and then returning into the hollow cavity by spring force when the hole or groove and the external surface of the reload insert is aligned with the end of the pin. Other embodiments of mechanical retention systems could include a lock wire or retaining ring that is placed in one end of the hollow cavity to secure the reload insert while maintaining the ease of loading and unloading. Another example could be the reload insert itself could be threaded on its external surface to match threads on interior surface of the hollow cavity, providing a means to screw the reload insert in and out of the shell base using common tools.

Another mechanical means of retention could be designed into the interface between the reload insert and the shell base such as steps or grooves that could lock the reload insert in place when it is inserted and turned in the shell base. A locking groove system would incorporate a reload with features that are keyed to the same pattern as the opening in the shell base, the keyed feature positioned axially on the reload to align with a radial groove on the interior of the shell cavity. The reload is inserted until the keyed feature and the groove align, and then rotated to lock the reload in place. Still another mechanical means of retaining the propulsion system reload could be an o-ring interface between the propulsion system reload and the interior surface of the hollow cavity in the shell base. The o-ring could be located either in a groove on the external surface of the propulsion system reload, meeting with the groove on the internal surface of the hollow cavity in the shell base, or vice versa wherein the o-ring is located in a groove on the internal surface of the hollow cavity of the shell base and mates with a groove on the surface of the propulsion system reload.

FIG. 3 also illustrates the principals of the high/low pressure propulsion system for the reload insert. The reload insert includes the vent hole 28 which separates the high pressure chamber 46 from the low pressure chamber 48.

The ammunition as shown in FIGS. 1-3 is, by way of example only, a 40 MM reloading training munition for non-lethal impact munitions, but the principals of the invention can easily be applied to other calibers and training ammunition applications.

All of the present invention has been illustrated with respect to several embodiments thereof, it is not to be so limited since changes and modifications can be made which are within the intended scope of the invention as hereinafter claimed.

What is claimed is:

1. A reloadable munition comprising:

a reusable shell base having a hollow cavity on a bottom face;

a reusable projectile that can be inserted into an end of the reusable shell base opposite from the hollow cavity;

a propulsion system reload inserted into the hollow cavity of the shell base by hand using no presses or vises or tools other than a small hand tool; and means for mechanically retaining the propulsion system reload in the shell base for loading and firing of the munition that is reversible and allows the propulsion system reload to be removed by hand using no presses or vises or tools other than a small hand tool.

2. The munition of claim 1 wherein the propulsion system reload is a high/low pressure propulsion system having a propellent charge, a primer, a rupture disc and a vent hole separating a high pressure chamber from a low pressure chamber in the shell base.

3. The munition of claim 1 wherein the mechanical means of retaining the propulsion system reload is a set screw that is threaded into a hole in a side of the shell base running perpendicular to a longitudinal axis of the shell base.

4. The munition of claim 1 wherein the munition is a 40 MM non-lethal impact munition.

5. A reloadable munition comprising:

a reusable shell base having a hollow cavity on a bottom surface;

a reusable projectile inserted into a top portion of the shell base;

a propulsion system reload positioned in the hollow cavity of the shell base by hand using no presses or vises or tools other than a small hand tool; and a set screw extending through the shell base to retain the propulsion system reload in the shell base.

6. The munition of claim 5 wherein the propulsion system reload is a high/low pressure propulsion system incorporating a propellant charge, a primer, a rupture disc and a vent hole separating a high pressure chamber from a low pressure chamber in the shell base.

7. The munition of claim 5 wherein the munition is a 40 MM non-lethal impact munition.

* * * * *